United States Patent [19]

Aoyama

[11] 4,248,833

[45] Feb. 3, 1981

[54] EXHAUST GAS PURIFIER SYSTEM FOR INTERNAL COMBUSTION ENGINE

[75] Inventor: Toshiho Aoyama, Nagoya, Japan

[73] Assignee: Chuo Hatsujo Kabushiki Kaisha, Aichi, Japan

[21] Appl. No.: 70,369

[22] Filed: Aug. 28, 1979

[51] Int. Cl.[3] ..... B01J 8/00; F01N 3/28; F01N 7/08; F01N 7/18

[52] U.S. Cl. ..... 422/179; 60/299; 422/180

[58] Field of Search ..... 422/177, 179, 180; 60/299; 181/227, 243, 282; 29/157 R

[56] References Cited

U.S. PATENT DOCUMENTS

| | | | |
|---|---|---|---|
| 2,909,415 | 10/1959 | Houdry | 422/179 |
| 3,042,138 | 7/1962 | Reinert | 422/177 |
| 3,817,714 | 6/1974 | Wiley | 422/180 |
| 3,854,888 | 12/1974 | Frietzsche et al. | 422/180 |
| 3,929,419 | 12/1975 | Chapman | 422/179 |
| 4,032,310 | 6/1977 | Inoffo | 422/177 |
| 4,158,037 | 6/1979 | Aoyama | 422/180 |

FOREIGN PATENT DOCUMENTS

| | | | |
|---|---|---|---|
| 2442488 | 3/1976 | Fed. Rep. of Germany | 422/180 |

*Primary Examiner*—Bradley R. Garris

*Attorney, Agent, or Firm*—Jordan and Hamburg

[57] ABSTRACT

A catalytic converter is mounted within an exhaust gas passage formed by a pair of tubular members each having an outwardly extending flange at their one end and connected together in tandem and in a concentric manner by means of mounting means which cooperate with the flanges. The catalytic converter includes a cylindrical, metallic shell having a pair of flanges at its opposite ends which extend radially inward and which define a gas inlet and a gas outlet, a catalyst carrier formed by a monolithic, porous ceramic body having a coating of catalyst, and elastic support means for supporting the catalyst carrier within the shell. The shell is provided with an annular rib having a pair of side surfaces which project outwardly from its cylindrical surface, the annular rib defining a pair of cylindrical portions of the shell which are contiguous with the respective side surfaces. The catalytic converter is disposed within the pair of tubular members by locating each of the cylindrical portions within the associated tubular member. By connecting the pair of tubular members together by the mounting means, the respective side surfaces of the annular rib engage the associated flanges on the tubular members, thereby supporting the catalytic converter within the gas passage.

10 Claims, 8 Drawing Figures

EXHAUST GAS PURIFIER SYSTEM FOR INTERNAL COMBUSTION ENGINE

FIELD OF THE INVENTION

The invention relates to an exhaust gas purifier system for internal combustion engine, and more particularly, to a catalytic converter of a cassette type which can be easily and detachably mounted in an exhaust gas passage of an internal combustion engine.

Catalytic purifier systems are known which are mounted in a gas passage of an automobile in order to remove toxic components contained in the exhaust gas. Such catalytic purifier system comprises a relatively long cylindrical metallic casing which serves as an exhaust gas or gas cooling pipe of an automobile, a monolithic porous ceramic body having a honeycomb structure which is provided with a catalyst coating, and an elastic support which supports the ceramic body within the casing. A catalyst carrier which is formed of a ceramic material is brittle and subject to breakage, and is also expensive. Hence, the elastic support must be capable of sufficiently protecting the catalyst carrier against severe mechanical oscillations which are transmitted through the casing. Thus, the elastic support must be capable of accommodating thermal strains which result from a high thermal load and rapid temperature changes to which both the casing and the catalyst carrier are subject, and must also be resistant to the degradation of the support material. A heat resistant cushion is known which comprises a woven structure formed with thin wires of stainless steel or special steel such as Inconel and which is compacted to shape. Such cushion is fully usable as the elastic support for practical purposes. However, a reduction in the capability of the catalyst, an abrasion of the catalyst carrier or a degradation of the elastic support result in an effective life of the catalytic purifier system which ends earlier than the life of the automobile. Consequently, it is desirable to provide a catalytic purifier system which is easily interchangeable and which enables an exhaust or a gas cooling pipe of the automobile to be left operative without being disposed of together with the purifier system at the time of such interchange since such pipe is then still fully capable of serving the intended purpose.

DESCRIPTION OF THE PRIOR ART

U.S. Pat. No. 4,158,037 filed by the present inventor and issued June 12, 1979 discloses a catalytic converter of cassette type which can be easily mounted in an exhaust gas passage of an automobile. When a pair of tubular members forming an exhaust gas passage, for example, an exhaust gas pipe and a muffler, are connected together, the catalytic converter is inserted into one of the tubular members and is firmly mounted within the gas passage when said one tubular member is connected with the other tubular member.

Specifically, the catalytic converter comprises a metallic, cylindrical shell having a pair of radially extending flanges at its opposite ends which define a gas inlet and a gas outlet, with a first circumferential portion located adjacent to the gas inlet and a second circumferential portion located adjacent to the gas outlet both having substantially the same external diameter while a third circumferential portion located between the first and the second circumferential portion has an increased external diameter to define a first tapered section between the first and the third portion and a second tapered portion between the second and the third portion; a catalyst carrier formed by a monolithic, porous ceramic body having a catalyst coating; and an elastic support which mounts the carrier within the shell. A pair of tubular members define a gas passage. One of the tubular members have an internal diameter which is greater than that of the third circumferential portion of the shell and is internally provided with an annular rib at a given spacing from an end thereof. The annular rib circumscribes a circle of a diameter which is greater than that of the first and the second circumferential portion and less than that of the third circumferential portion of the shell. The converter is held between these tubular members with the first or the second tapered portion of the shell engaged with the annular rib of said one tubular member which urges the shell into abutment against an adjacent end of the other tubular member.

In the disclosed converter, it is necessary to form the annular rib of a given size on the internal surface of said one tubular member at a predetermined distance from an end thereof, requiring a degree of high precision machining operation. The use of a tubular member of a given configuration prevents the application of the present invention to an exhaust gas passage which comprises an exhaust gas pipe and a muffler of an existing automobile.

SUMMARY OF THE INVENTION

It is an object of the invention to provide an exhaust gas purifier system for an internal combustion engine including a catalytic converter of cassette type similar to that disclosed in U.S. Pat. No. 4,158,037 and which is simplified in construction and easy to manufacture.

According to the invention, there is provided an exhaust gas purifier system for an internal combustion engine which comprises a pair of tubular members which constitute together an exhaust gas passage and each having a flange at its one end, means for connecting the tubular members in tandem at the flanges in a concentric manner, and a catalytic converter disposed within the exhaust gas passage and including a metallic shell having an annular rib which engages the both flanges. The pair of tubular members may comprise an exhaust gas pipe and a muffler each having a flange at its one end. Hence the invention can be easily applied to existing automobiles.

In accordance with the invention, there is provided a catalytic converter adapted to be disposed in an exhaust gas passage formed by a pair of tubular members each having an outwardly extending flange at its one end, the flanges cooperating with mounting means to connect the tubular members in tandem and in a concentric manner, and including a cylindrical metallic shell having a pair of flanges at its opposite ends which extend radially inward and which define a gas inlet and a gas outlet, respectively, a catalyst carrier formed by a monolithic, porous ceramic body having a catalyst coating, and elastic support means for supporting the catalyst carrier within the shell; characterized in that the shell is provided with an annular rib having a pair of side surfaces which project outwardly from the cylindrical surface thereof, the annular rib defining a pair of cylindrical portions of the shell which are contiguous with respective side surfaces, the catalytic converter being inserted into the pair of tubular members such that the individual cylindrical portions of the shell are located within the associated tubular members, whereupon the respective side surfaces of the annular rib engage the associated flanges of the tubular members whereby the catalytic converter is supported within the gas passage.

In a preferred embodiment of the invention, the annular rib on the shell has a V-shaped construction the edge of which lies in a plane perpendicular to the axis of the shell. The pair of tubular members which receive the shell therein are each provided with a flange at its one end which extends in an oblique direction. Mounting means may comprise a clamping band having an arcuate section which extend over the edge of the annular rib to engage the both flanges.

In another embodiment of the invention, the annular rib on the shell extends in a direction perpendicular to the axis of the shell, and is provided with a plurality of openings therein which extend parallel to the axis. The catalytic converter including the shell is applied to a gas passage comprising an exhaust gas pipe and a muffler of an existing automobile, each of which is provided with a flange at its one end which extends in a direction perpendicular to the axis of the shell, the flanges being connected together by a plurality of sets of the screws and nuts. The only requirement is that the both flanges of the exhaust gas pipe and muffler are disposed to hold the annular rib extending from the shell therebetween which is inserted into the gas passage.

DESCRIPTION OF PREFERRED EMBODIMENTS

Figure 1:
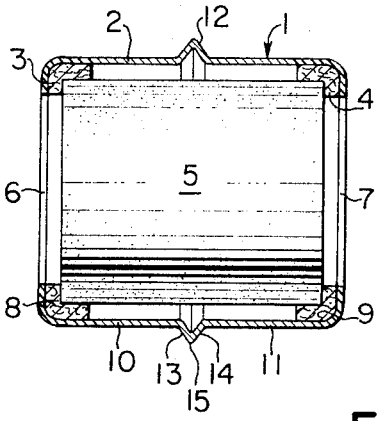
FIG. 1 is a cross section of the catalytic converter of cassette type according to the invention.

Referring to FIG. 1, there is shown a catalytic converter of cassette type which is designated by reference numeral 1. It comprises a metallic, cylindrical shell 2, and a catalyst carrier 5 which is supported inside the shell 2 by a pair of L-shaped annular elastic supports 3, 4. At its opposite ends, the shell 2 is provided with a pair of flanges 8, 9 which extend radially inward and which define a gas inlet 6 and a gas outlet 7. A first circumferential portion 10 and a second circumferential portion 11 of the shell 2 which are located adjacent to the gas inlet 6 and the gas outlet 7, respectively, have an equal diameter, with an annular rib 12 formed therebetween. The annular rib 12 has a V-shaped cross section defined by a pair of inclined surfaces 13, 14 which are contiguous with the respective circumferential portions 10, 11, with an edge 15 being located in a plane which is perpendicular to the axis of the shell 2. The elastic supports 3, 4 may comprise a metal meshwork cushion of a known form, and are fitted around the inlet 6 and the outlet 7, respectively. The catalyst carrier 5 is well known and therefore requires no detailed description. However, briefly, it comprises a monolithic ceramic body having a honeycomb structure including a plurality of open-ended cells extending across the opposite ends, with the surface of each cell being coated with a catalyst such as platinum, for example. The catalyst carrier 5 is resiliently supported both axially and radially within the shell 2 by means of the elastic supports 3, 4 which have an L-shaped cross section. As is known, these supports may be replaced by respective pairs of radial supports and axial supports.

Figure 2:
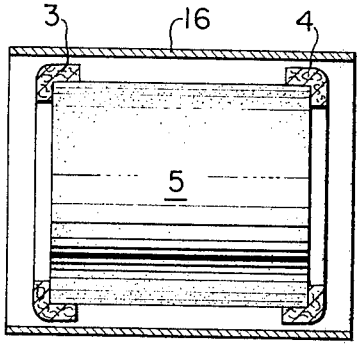
FIG. 2 is a cross section illustrating the manufacture of the catalytic converter shown in FIG. 1.

FIG. 2 illustrates the manufacture of the catalytic converter shown in FIG. 1. The catalyst carrier 5 having the annular elastic supports 3, 4 mounted thereon is inserted into a metal pipe 16, which is then drawn into the shell 2, using a known roll drawing machine or a press drawing machine. The metal pipe 16 has a diameter and an axial length which are greater than the given size of the shell 2, and during the drawing operation, the opposite sides exclusive of the central portion are initially drawn in the radial direction to define the rib at the center thereof, followed by folding the opposite ends radially inward. While the shell is drawn in this manner, both the axially extending and the radially extending portion of the elastic supports 3, 4 are compressed or compacted from its normal solid-state density to a desired solid-state density. A desired solid-state density for the elastic supports which are formed by a metal meshwork cushion is specifically disclosed in Japanese Laid-Open Patent Application No. 50-60466 which is based on a U.S. Patent Application Ser. No. 401,023 filed Sept. 26, 1973. By way of example, the desired density is in a range from 0.2 to 3.0 g/cm$^3$ for a meshwork cushion employing stainless steel wires having a diameter of 0.15 mm. The resulting catalytic converter is compact in form, and hence can be easily transpoated in a simple package.

Figure 3:
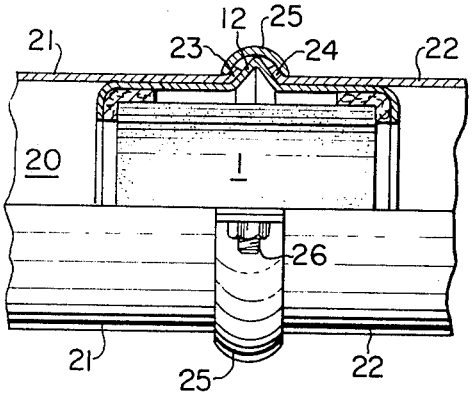
FIGS. 3, 4 and 5 are side elevations, partly in section, of the exhaust gas purifier system for an internal combustion engine which incorporates the catalytic converter shown in FIG. 1.

Referring to FIG. 3, there is shown an exhaust gas passage 20 of an internal combustion engine which is formed by a first tubular member 21 and a second tubular member 22 which are disposed in tandem and in a concentric manner. The catalytic converter 1 is adapted to be mounted within the passage. The first tubular member 21 may comprise a conventional exhaust gas pipe and the second tubular member 22 may be a conventional muffler. However, it is to be noted that each tubular member 21, 22 is provided with a flange 23, 24 at its one end which extends outwardly in an oblique direction. The first tubular member 21 has an internal diameter which is slightly greater than that of the first circumferential portion 10 of the shell 2, and its inclined flange 23 is disposed at an angle of inclination which is substantially equal to that of one of the inclined surfaces of the annular rib 12. Similarly, the second tubular member 22 has an internal diameter which is slightly greater than that of the second circumferential portion of the shell 2 and its inclined flange 24 is disposed at an angle of inclination which is substantially equal to that of the other inclined surface of the annular rib 12.

The catalytic converter 1 is mounted within the exhaust gas passage by inserting the first circumferential portion 10 into the first tubular member 21 and inserting the second circumferential portion 11 into the second tubular member 22, and sliding the tubular members over the respective circumferential portions until the inclined surfaces 13, 14 of the annular rib 12 are engaged by the inclined flanges 23, 24 of the associated tubular members. Subsequently, the both tubular members 21, 22 are firmly clamped together by a mounting metal band 25 having an arcuate cross section and which is provided with a clamping screw 26 which forces the flanges 23, 24 against the opposite sides of the annular rib 12 disposed therebetween. Specifically, the opposite edges of the band 25 engage the inclined flanges of the both tubular members, which are forced to move toward each other as the screw 26 is tightened. Desirably the dimension of the parts are chosen such that no substantial clearance is produced between the tubular members 21, 22 and the associated circumferential portions 10, 11 of the shell 2. However, a certain clearance may be left so long as a firm engagement is assured between the flanges 23, 24 and the annular rib 12.

Figure 4:
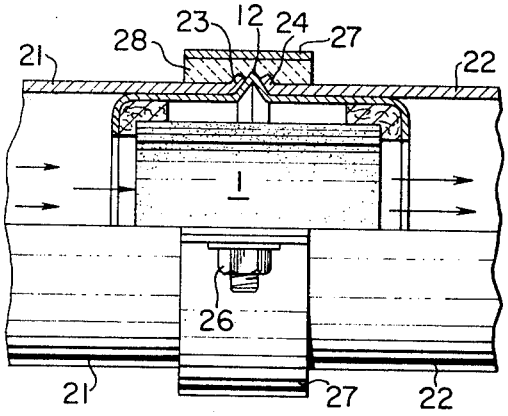

FIG. 4 illustrates a modification in which the mounting band 25 is replaced by a flat mounting band 27. A heat resistant gasket 28 formed of a material such as asbestos is placed inside the band 27, and is sufficiently compressed as the screw 26 is tightened, allowing the inclined flanges 23, 24 to be forced into the gasket 28 together with the annular rib 12. As a result, the both tubular members 21, 22 are connected together in a rigid manner.

Figure 5:
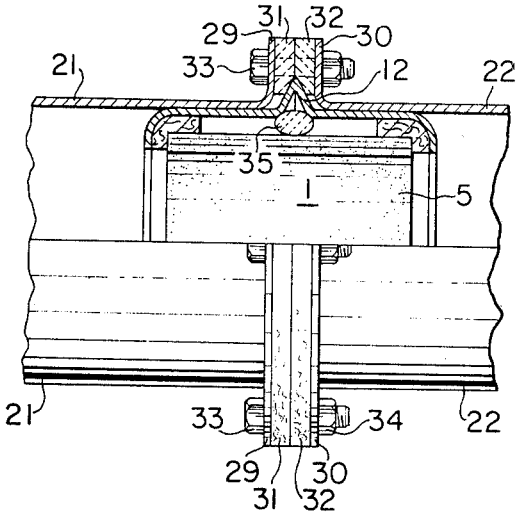

In an arrangement shown in FIG. 5, the tubular members 21, 22 are provided with vertical flanges 29, 30 at their one end, each of which extends in a plane perpendicular to the axis thereof in the same manner as a conventional exhaust gas pipe and muffler. A pair of heat resistant gaskets 31, 32 of a material such as asbestos are disposed between the flanges 29, 30, and engage the individual inclined surfaces 13, 14 of the annular rib 12. The flanges 20, 30 are connected together by a plurality of screws 33, with the annular rib 12 forcibly held between the gaskets. These screws 33 extend through holes (shown in dotted lines) formed in both gaskets 31, 32 and flanges 29, 30 and threadably engage nuts 34. In this manner, the annular rib 12 is firmly held between the flanges 29, 30 with the gaskets 31, 32 interposed therebetween. With this arrangement, an annular gasket 35 is disposed between the internal surface of the annular rib 12 and the catalyst carrier 5, and serves preventing the leakage of a gas through the elastic supports 3, 4. Thus it will be seen that the catalytic converter can be easily mounted within an exhaust gas passage which comprises an exhaust gas pipe and a muffler of an existing automobile.

Figure 6:
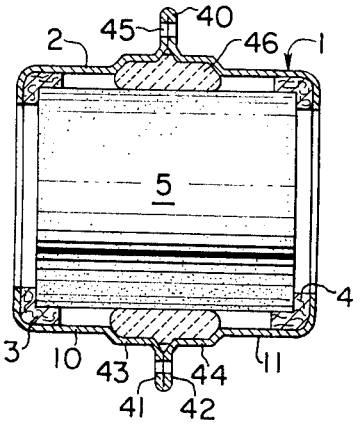
FIG. 6 is a cross section of a catalytic converter of cassette type which is slightly modified from that shown in FIG. 1.
Figure 7:
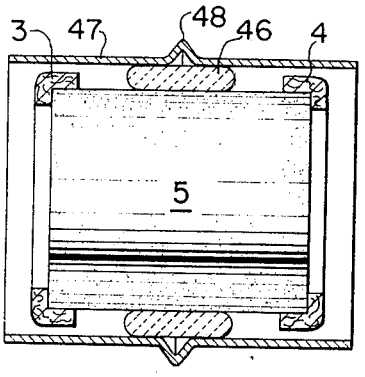
FIG. 7 is a cross section illustrating the manufacture of the catalytic converter shown in FIG. 6.

In FIG. 6, there is shown a catalytic converter 1 having a shell 2 which is provided with a slightly modified form of annular rib 40. The annular rib 40 comprises a pair of limbs 41, 42 which extend in a plane perpendicular to the axis of the shell 2, and these limbs 41, 42 are contiguous with shoulders 43, 44 formed in the associated circumferential portions 10, 11. A heat resistant gasket 46 is disposed between the shell 2 and the catalyst carrier 5 in a region defined between the both shoulders 43, 44. As shown, the annular rib 40 is formed with a plurality of holes 45. It will be understood that such a catalytic converter can be manufactured in the same manner as that shown in FIG. 1. However, it will be noted from FIG. 7 that a metal pipe 47 which is to be formed into the shell 2 is previously formed with a rib 48 which has a V-shaped cross section. Such rib can be provided by using a conventional roll drawing machine or a press drawing machine. The catalyst carrier 5 having the pair of elastic supports 3, 4 and gasket 46 mounted thereon is disposed within the pipe 47, and subsequently the pipe is drawn into shape in the same manner as mentioned above in connection with FIG. 2. As a result of such a drawing operation, the elastic supports 3, 4 are compressed to a solid-state density which is effective to provide a reliable support for the catalyst carrier 5. The gasket 46 will be also compressed to a higher density which is effective to prevent a gas leakage through any clearance between the shell 2 and the catalyst carrier 5. The previous formation of the rib 48 is useful in preventing the risk of the catalyst carrier 5 being damaged during the drawing operation.

Figure 8:
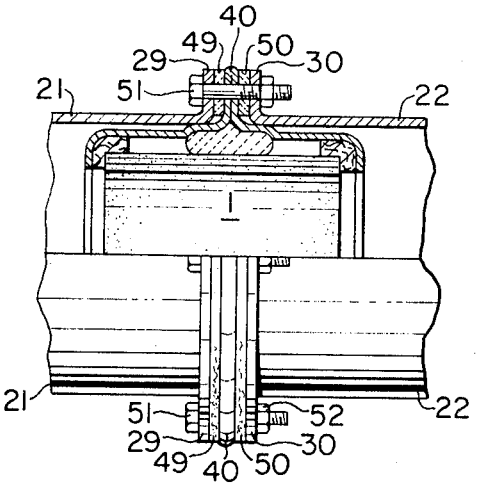
FIG. 8 is a side elevation, partly in section, of the exhaust gas purifier system for an internal combustion engine which incorporates the catalytic converter shown in FIG. 7.

Referring to FIG. 8, the catalytic converter 1 of FIG. 6 is shown as mounted within the gas passage formed by the pair of tubular members 21, 22 which are similar to those shown in FIG. 5. The vertical flange 29, 31 of the tubular members 21, 22 are disposed to engage the vertical limbs 41, 42 (see FIG. 6) of the annular rib 40 with heat resistant gaskets 49, 50 interposed therebetween. The flanges are connected together by a plurality of screws 51 which forcibly clamp the rib 40 between the flanges of the tubular members. These screws 51 extend through holes formed in the flanges 29, 30, the gaskets 49, 50 and the annular rib 40, and threadably engage nuts 52. The internal surface of the individual tubular members 21, 22 engage the associated shoulders 43, 44 of the shell 2. It is to be noted that the first circumferential portion 10 and the second circumferential portion 11 are spaced apart. The provision of such a spacing advantageously facilitates the insertion or removal of the catalytic converter 1 into or out of the tubular members 21, 22. However, it should be understood that the shoulders 43, 44 may be omitted and the circumferential portions 10, 11 may have a diameter which is a close fit within the associated tubular members 21, 22.

While preferred embodiments of the invention have been described in detail above, it should be understood that they are exemplary only, and not limitative of the invention. A number of modifications and changes will readily occur to those skilled in the art, and hence it is intended that the scope of the invention be defined by the appended claims.

What is claimed is:

1. A catalytic converter adapted to be disposed in an exhaust gas passage formed by a pair of tubular members each having an outwardly extending flange at its one end, the flanges cooperating with mounting means to connect the tubular members in tandem and in a concentric manner, and including a cylindrical metallic shell having a pair of flanges at its opposite ends which extend radially inward and which define a gas inlet and a gas outlet, respectively, a catalyst carrier formed by a monolithic, porous ceramic body having a catalyst coating, and elastic support means for supporting the catalyst carrier within the shell; characterized in that the shell is provided with an annular rib having a pair of side surfaces which project outwardly from the cylindrical surface thereof, the annular rib defining a pair of cylindrical portions of the shell which are contiguous with respective side surfaces, the catalytic converter being inserted into the pair of tubular members such that the individual cylindrical portions of the shell are located within the associated tubular members, whereupon the respective side surfaces of the annular rib engage the associated flanges of the tubular members whereby the catalytic converter is supported within the gas passage.

2. A catalytic converter according to claim 1 in which the annular rib has a V-shaped cross section defined by the pair of side surfaces, with the edge therebetween lying on a plane which is perpendicular to the axis of the shell.

3. A catalytic converter according to claim 1 in which the annular rib is defined by a pair of mutually contacting side surfaces which are perpendicular to the axis of the shell and which are formed with a plurality of holes extending parallel to the axis of the shell.

4. An exhaust gas purifier system for an internal combustion engine comprising a pair of tubular members which define an exhaust gas passage, means for connecting the tubular members in tandem and in a concentric manner, and a catalytic converter mounted within the gas passage, the catalytic converter including a cylindrical metallic shell having a pair of flanges at its opposite ends which extend radially inward and which define a gas inlet and a gas outlet, respectively, a catalyst carrier formed by a monolithic porous ceramic body having a coating of catalyst, and elastic supports for supporting the catalyst carrier within the shell, the shell being provided with an annular rib having a pair of side surfaces which project outwardly from its cylindrical surface and which define a pair of cylindrical portions of the shell contiguous with the side surfaces, each of the pair of the tubular members having an internal diameter which is greater than the external diameter of each cylindrical portion and less than the external diameter of the annular rib, each of the tubular members being provided with an outwardly extending flange at its one end, the catalytic coverter being disposed within the pair of tubular members by locating the respective cylindrical portions of the shell in the associated tubular members with the side surfaces of the annular rib engaging the corresponding flanges of the tubular members, said connecting means cooperating with the flanges on the tubular members to connect them together, thereby securing the catalytic converter in place.

5. An exhaust gas purifier system according to claim 4 in which the pair of side surfaces of the annular rib define a V-shaped cross section, with its edge lying on a plane perpendicular to the axis of the shell, each of the flanges of the tubular members being inclined with respect to a plane which is perpendicular to the axis of the respective tubular member so as to fit the respective side surface of the annular rib, said connecting means including an annular band having an arcuate cross section and which surrounds the both flanges of the tubular members together with the annular rib, and means for clamping the annular band.

6. An exhaust gas purifier system according to claim 4 in which the annular rib presents a V-shaped cross section defined by the pair of side surfaces with its edge lying on a plane perpendicular to the axis of the shell, each of the flanges of the tubular members being inclined with respect to a plane which is perpendicular to the axis of the associated tubular members so as to fit the respective side surfaces of the annular rib, the connecting means including an annular band having a flat cross section which surrounds the both flanges of the tubular members and the annular rib, a gasket uniformly disposed inside the internal side surface of the band and means for clamping the annular band.

7. An exhaust gas purifier system according to claim 4 in which the annular rib presents a V-shaped cross section defined by the pair of side surfaces with its edge lying on a plane perpendicular to the axis of the shell, each of the flanges on the tubular members extending in a direction perpendicular to the axis of the tubular members, said connecting means including means which clamps the both flanges toward each other so as to hold the annular rib therebetween.

8. An exhaust gas purifier system according to claim 7 in which each of the flanges of the tubular members is formed with a plurality of the holes extending axially of the respective tubular members and in which said connecting means comprises a pair of gaskets disposed against each of the flanges, and a plurality of screws extending through the holes in the flange and through the gaskets and engaging corresponding nuts.

9. An exhaust gas purifier system according to claim 4 in which the annular rib is formed by a pair of mutually contacting side surfaces which extend in a direction perpendicular to the axis of the shell, each of the flanges on the tubular members extending perpendicular to the axis of the respective tubular members, said connecting means including means which clamp the both flanges toward each other so as to hold the annular rib therebetween.

10. An exhaust gas purifier system according to claim 9 in which the annular rib is formed with a plurality of holes extending axially of the shell, each of the flanges on the tubular members also being formed with a plurality of holes extending axially of the tubular members, the connecting means comprising a pair of gaskets each disposed between the flange of the respective tubular member and the annular rib on the shell, and a plurality of screws extending through the gasket and through holes formed in the annular rib and the flanges to engage corresponding nuts.

* * * * *